US005215075A

United States Patent [19]

Caridis et al.

[11] Patent Number: 5,215,075

[45] Date of Patent: Jun. 1, 1993

[54] COOKING SYSTEM HAVING AN EFFICIENT POLLUTION INCINERATING HEAT EXCHANGER

[75] Inventors: Andrew A. Caridis, San Carlos; Lawrence F. Klein, Hillsborough, both of Calif.

[73] Assignee: Heat and Control, Inc., South San Francisco, Calif.

[21] Appl. No.: 766,714

[22] Filed: Sep. 27, 1991

[51] Int. Cl.[5] ..... F24C 15/20

[52] U.S. Cl. ..... 126/300; 126/80; 431/5; 99/403; 55/DIG. 36

[58] Field of Search ..... 126/299 R, 80, 390, 126/391, 392, 300; 110/203, 211, 213, 214, 217; 431/116, 5; 99/330, 403, 408; 55/DIG. 36, 220, 222, 269, 279, 385.3, 267

[56] References Cited

U.S. PATENT DOCUMENTS

| | | | |
|---|---|---|---|
| 3,609,073 | 9/1971 | Robinson | 431/116 |
| 3,762,394 | 10/1973 | Newcomer | 126/300 |
| 3,766,906 | 10/1973 | Jenn | 126/299 R |
| 3,933,145 | 1/1976 | Reich | 126/299 R |
| 4,363,642 | 12/1982 | Stahl | 55/DIG. 36 X |
| 4,484,563 | 11/1984 | Fritz et al. | 55/DIG. 36 X |
| 5,050,508 | 9/1991 | Wilson | 55/267 X |

OTHER PUBLICATIONS

Heat and Control drawing No. P1-2328, entitled KLEENHEAT POLLUTION CONTROL HEAT EXCHANGER, dated Feb. 15, 1989.

RELUTHERM Bulletin, dated pre-1985.

Heat and Control drawing No. J4-2837-200, entitled COMBUSTION CHAMBER KHX-2.0, dated Nov. 26, 1990.

*Primary Examiner*—Larry Jones

*Attorney, Agent, or Firm*—Flehr, Hohbach, Test, Albritton & Herbert

[57] ABSTRACT

Odor/pollutants from cooking food products are collected and delivered to a plenum proximate the burner of a heat exchanger which serves the food cooker. The burner issues a flame into a combustion chamber having a baffle arranged normal to the flame and a central opening in the baffle is partially occluded by a frustoconically shaped turbulence increasing body spaced from the baffle to define an annular flow slot along the body which is has an central flow passageway therethrough. Efficient pollution vapor incineration results.

5 Claims, 3 Drawing Sheets

COOKING SYSTEM HAVING AN EFFICIENT POLLUTION INCINERATING HEAT EXCHANGER

TECHNICAL FIELD

This invention pertains to flame fire heat exchangers for cooking systems where atmospheric pollutants are generated from the cooking process and are circulated to the heat exchanger for treatment.

BACKGROUND OF THE INVENTION

The cooking of potato chips, corn chips, chicken, meat balls and the like in a hot oil bath causes a mist to be generated over the bath. This mist includes hydrocarbons, particulates, oil droplets, smoke, water released from the food product as well as fats and other carbonaceous and odor creating elements released during the cooking process. These will be called "pollutants" below. While at one time it was common to release such pollutants to the atmosphere, today's clean air requirements prescribe that a plant operator minimize to a high extent the amount of pollutants released into the environment.

To achieve a minimal release of pollutants it has been observed that improvements are required to heat exchangers used in food cooking systems for remote heating of either a cooking fluid such as oil or water or the heating of a heat transfer fluid such as a thermal oil. Such improvements should produce a result that the odors emitted from the system are greatly reduced, if not undetectable, which is the most desirable condition indicating that pollutants are at a very low acceptable level. It is believed that the delivery of a large amount of the pollutants from the cooker to the heat exchanger combustion chamber often times passes through the combustion chamber and out the exhaust stack leaving a telltale smell in the vicinity of the plant and this is objectionable. The flow of gases in the combustion chamber, it is believed, is in a laminar pattern which tends to minimize mixing of the pollutants with the combustion gases. Thus, improvements in the combustion chamber design should ideally give a higher measure of mixing such as generating a greater amount of turbulent flow of the pollutant vapors and the combustion products so that a very minimum of odor is detectable issuing from the heat exchanger stack. A known parameter for dwell time or residence time of gases in a combustion chamber is three-tenths of a second at 1400° F. and, when products are held for this time in the combustion chamber, thorough treatment and odor reduction is achieved provided there is sufficient turbulence to ensure mixing of the pollutants and combustion gases.

SUMMARY OF THE INVENTION AND OBJECTS

The invention in summary is directed to a flame fired heat exchanger incorporated in a system for cooking a food product in a cooking fluid thereby generating cooking vapors and odor pollutants, such vapors and pollutants being released to the combustion chamber of the heat exchanger for incineration. The improvement comprises a housing enclosing a tube array carrying the cooking fluid or heat transfer fluid (thermal oil) to be heated for cooking the food product and a combustion chamber having burner means arranged therein for projecting a flame into the combustion chamber. Plenum means are disposed on the housing for receiving the cooking vapors from the cooking system and having a discharge opening for releasing vapors and odor pollutants into the combustion chamber. Baffle means are mounted in the combustion chamber extending thereacross and spaced from the burner to just beyond the coolest portion of the burner flame and having a central opening in the baffle serving to pass combustion gases therethrough along a path toward the tube array and to an exhaust discharge. A frusto-conically shaped body is mounted in the combustion chamber in a spaced-apart relationship from the baffle so as to increase the turbulence in the flow and to define an annular slot along the sidewalls of the body through the opening in the baffle. The body projects towards the burner flame and has a central flow passageway therethrough.

A general object of the invention is to provide an improvement for a heat exchanger used in a cooking system where pollutants are generated and are delivered to the heat exchange combustion chamber and incinerated to a higher degree than previously so that odor pollutants are minimized in the exhaust to the atmosphere.

Another object of the invention is to provide an improvement in a heat exchanger of the type described wherein means are arranged in the combustion chamber to greatly increase turbulent flow and to reduce laminar flow in the pollutant gases and combustion products providing a higher degree of incineration efficiency.

Another object of the invention is to provide a cooking system including a heat exchanger which is highly efficient in operation, economical to manufacturer and which materially reduces the atmospheric pollutants outside of the plant in which it is installed.

These and other objects of the invention will become apparent in view of the Detailed Description of the Invention discussed below when taken in connection with the following drawings.

DETAILED DESCRIPTION OF THE INVENTION

Figure 1:
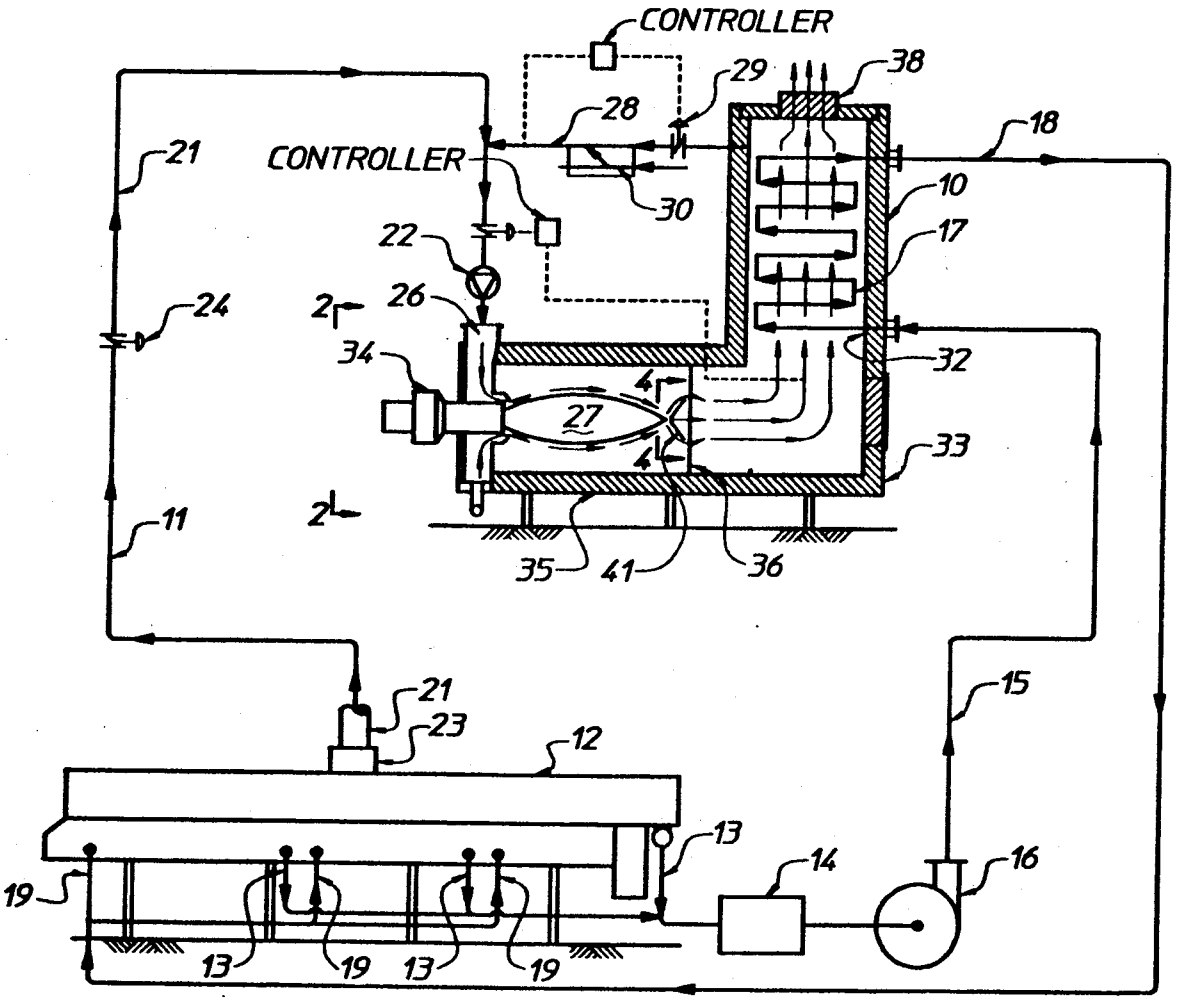
FIG. 1 is a schematic view of a food cooking system wherein the cooking fluid is heated in a pollution-controlled heat exchanger having incorporated therein the features of the present invention.

As shown in FIG. 1 of the drawings, a flame fired heat exchanger 10 made in accordance with and embodying the principles of the present invention is arranged in a system 11 for cooking a food product in a cooker 12. The cooker 12 may be equipped for cooking potato chips, corn chips, chicken parts, meat balls and the like and, to this end, is provided with a cooking fluid or heat transfer fluid maintained by the heat exchanger 10 in the desired cooking range typically from about 180° to about 400° F. and in the case of a heat transfer fluid in a range of from 400° to about 600° F. One or more oil outlets 13 from the cooker 12 deliver oil to a finds removal unit 14 where solids are removed from the cooking oil before delivery to a main system pump 16 which delivers oil in the direction of the arrows 15 to a heating tube bundle 17 of the heat exchanger 10 for reheating. The oil emerges from the tube bundle 17 and is delivered by the conduit 18 through one or more oil inlets 19 into the cooker 12.

To prevent vapor emissions from the cooker 12 from polluting the atmosphere surrounding the plant where the system 11 is installed, the pollutants generated in the cooking process within the cooker 12 are collected from a cooker exhaust 21. A fan 22 creates a draft or a negative pressure over the cooking fluid in the cooker 12 so that the vapors from the cooking products are drawn through the exhaust 21, first encountering an oil mist eliminator 23 which serves to remove oil droplets from the cooker exhaust for reuse of the oil in the process. A control 24 is interposed in the cooker exhaust line 21 ahead of the fan 22 so that the cooker exhaust may be delivered to a plenum 26 downstream of the fan 22, the plenum being equipped to exhaust vapors from the cooker 12 to a location within the heat exchanger 10 adjacent to the burner 34 for entrainment into the turbulent flow of the products of combustion. An air dilution stream including fresh air and exhaust from the heat exchanger is delivered through the conduit 28 into the cooker exhaust 21 flow and is controlled by the regulators 29 and barometric damper 30 to ensure that the necessary volume mixture and temperature of the mixture reaches the plenum 26 and discharges into a combustion chamber 31 of the heat exchanger 10.

The heat exchanger 10, shown schematically in FIG. 1, is generally L-shaped having a generally horizontally disposed combustion chamber 31 arranged at a right angle to the tube bundle compartment 32 which houses the tube bundle 17. The walls of the heat exchanger 10 are formed from steel and are well-insulated as indicated by the cross-hatching in FIG. 1 with use of refractories 33 well-known in the industry. A burner 34 is mounted at one end of the combustion chamber 31 and may burn either liquid or gaseous fuel as dictated by fuel availability and cost. The burner is arranged to project the flame 27 axially along the center portion of the combustion chamber 31 towards a baffle 36 having a central orifice 37 through which the combustion gases must flow from the combustion chamber 31 to the exhaust 38 of heat exchanger 10.

Figure 5:
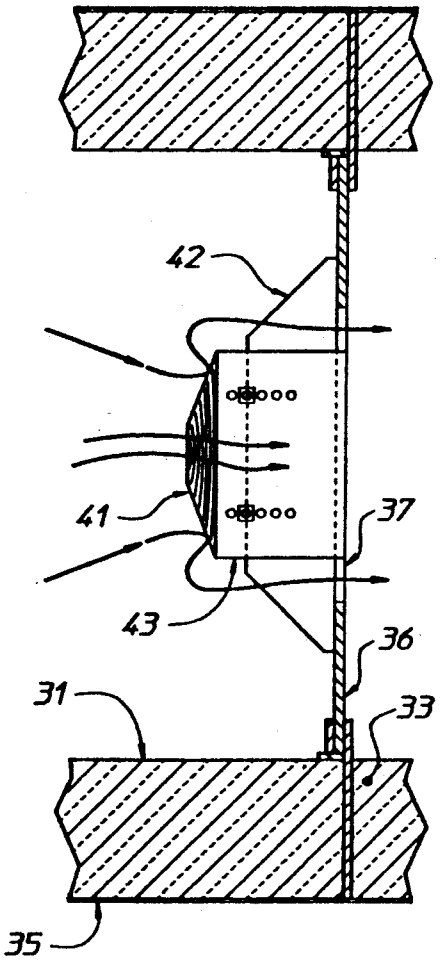
FIG. 5 is a view taken in the direction of the arrows 5—5 of FIG. 4.
Figure 4:
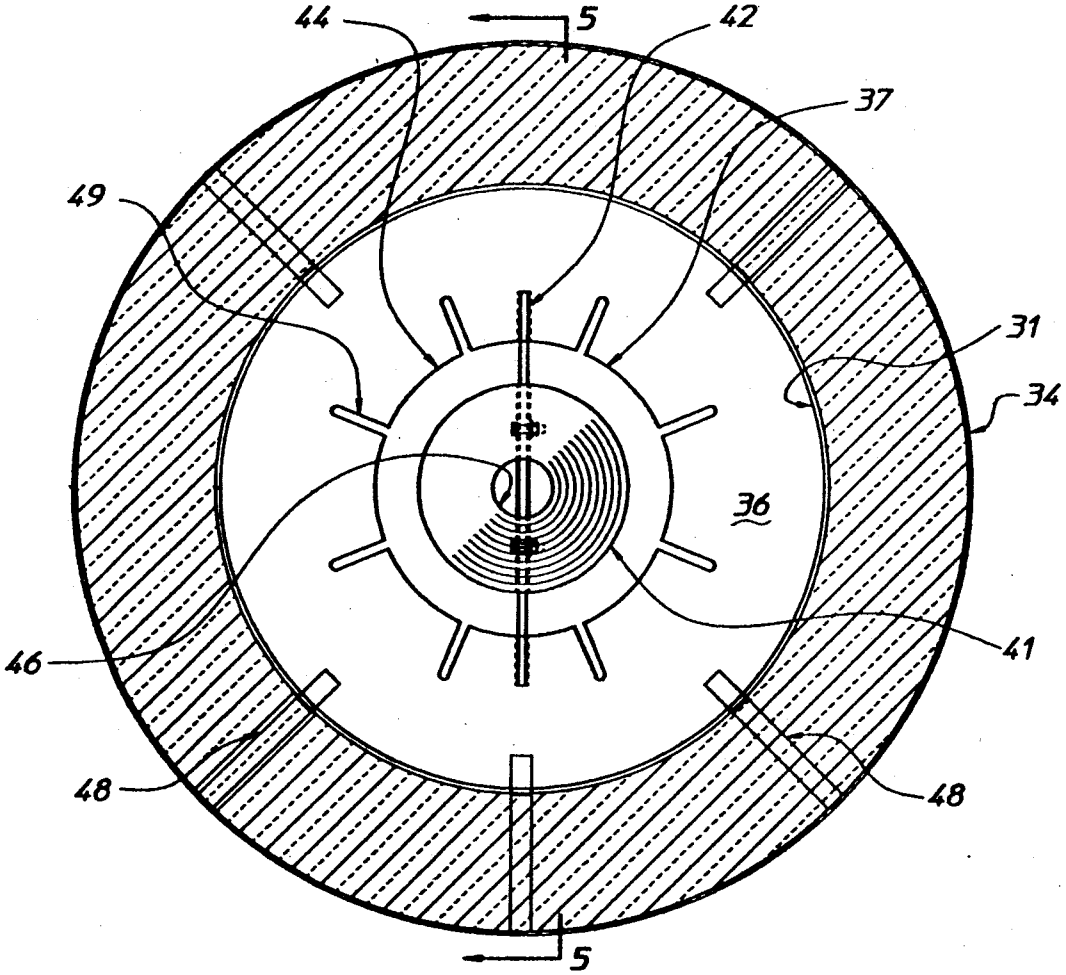
FIG. 4 is a sectional view taken in the direction of the arrows 4—4 of FIG. 1.

So as to increase turbulence for mixing and reduce laminar gas flow within the combustion chamber, there is mounted in a substantially occluding relationship with respect to the aperture or orifice 37 a frusto-conically shaped body 41 mounted with the larger base disposed away from the flame and the narrower base disposed closer to the flame 27, FIGS. 4 and 5. The conical-like member 41 is supported from the baffle plate 36 by one or more gusset plates 42 and is arranged concentric with the orifice 37 so as to provide, as viewed in FIG. 4, an annular slot 44 through which the combustion gases flow. In other words, the conical body 41 serves somewhat as a plug or target within the combustion chamber for increasing the turbulence, uniformity of gas temperature and uniformity of gaseous mixing between the pollution gases introduced into the combustion chamber from the plenum 26 and the products of combustion released by the burner 34. The plug or target 41 has a centrally arranged opening 46 which serves as a gas passageway into the tube chamber 32. Thus, the flow of heating gases from the combustion chamber to the tube chamber takes place through the annular slot 44 and through the cylindrical opening 46. The presence of the opening serves to reduce laminar flow along the conical surface of the body 41 and to reduce the stagnation zone of gas flow behind or downstream of the body 41.

A typical effective relationship between the inside radius "A" of the combustion chamber 31, the radius "B" of the orifice 37 and the radius "C" of the base of the plug 41 is as follows: A=36 inches; B=22.5 inches; and C=21 inches. The distance from the baffle plate 36 to the base of the plug 41 can be about 16 inches.

These dimensions were selected so as to create a condition within the combustion chamber of reduced laminar gaseous flow and increased turbulent flow. At typical firing rates to maintain a combustion chamber temperature of about 1400 F., the gas flow across the target or plug 41 as indicated generally by the arrows in FIG. 5 generates a vena contracta which is larger in area than the orifice 37 and which dwells a distance upstream from the baffle plate 36. Gas flow through the orifice 37 generates a vena contracta which is smaller in area than the orifice 37 and which dwells a distance downstream from the baffle plate 36. This serves to create a more turbulent condition and to hold the gases in the combustion chamber a somewhat longer time than if the foregoing structures were absent. One important result is a decrease in laminar flow through the combustion chamber with increased temperature and mixing uniformity of the pollutants with the combustion gases to achieve a more complete incineration of the pollutants, reaching the desired low level of pollutant emissions into the atmosphere from the heat exchanger exhaust 38.

So that the position of the plug or target body 41 may be optimized with respect to the most desirable position as to the selected temperature zone of the flame and its location on the orifice plate 36, one or more gusset members 42 and supports 43 are provided with a series of openings and fasteners whereby different positions may be selected for adjustment of the body 41.

The baffle 36 is supported from the steel sidewall 34 of the heat exchanger by the arcuately-spaced gussets 48 as shown in FIG. 4. Slots 49 are cut in the baffle plate 36 opening into the orifice 37 so as to accommodate for expansion and contraction of the baffle plate in accordance with the heat load imposed upon it.

Figure 3:
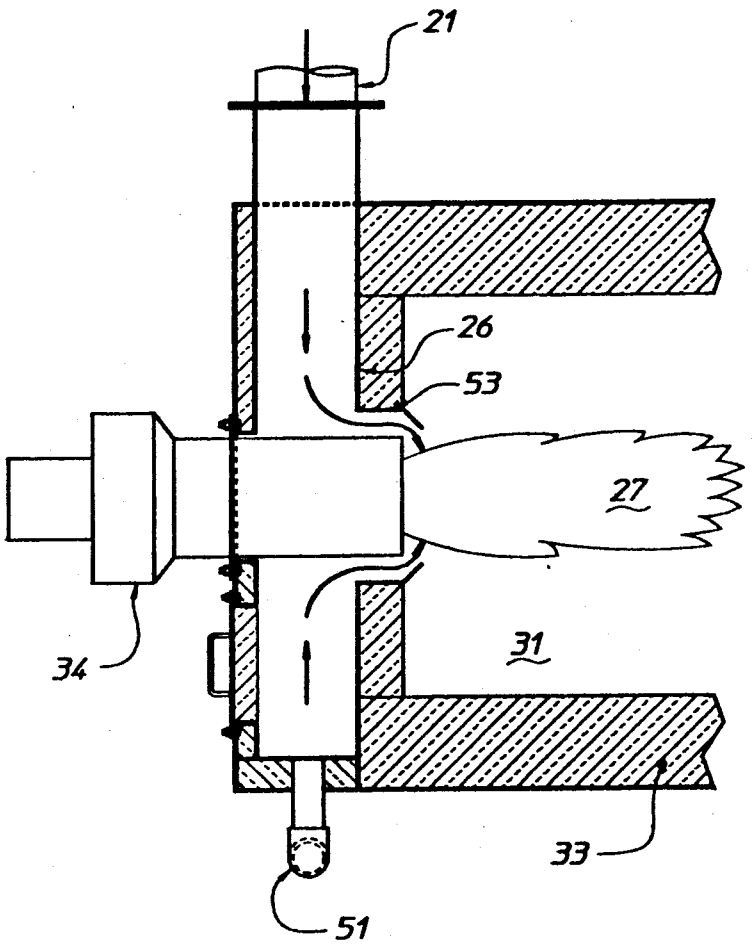
FIG. 3 is a view taken in the direction of the arrows 3—3 of FIG. 2.
Figure 2:
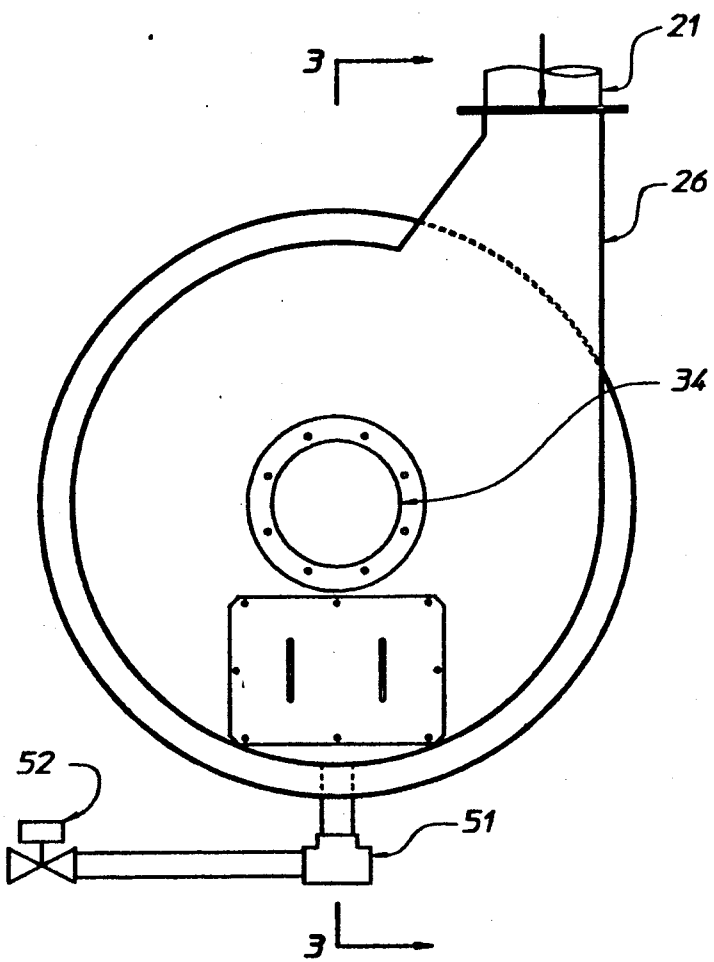
FIG. 2 is a view taken in the direction of the arrows 2—2 of FIG. 1.

Referring more particularly to FIGS. 2 and 3, the plenum 26 is equipped with a drain 51 and discharge valve 52 so that any liquid collected therein may be removed. It will be seen that the neck 53 of the plenum enshrouds the burner flame 27, thus ensuring that pollution products delivered by the pollution fan to the plenum will be introduced into the combustion chamber in pattern concentric with the burner flame 27.

While a preferred embodiment of the invention has been disclosed herein, there are some modifications and adaptations which will occur to those skilled in the field and the above description and illustration of the drawings is intended to be exemplary of only one form of the invention.

What is claimed is:

1. In a flame fired heat exchanger coupled to a system for cooking a food product in a cooking fluid thereby generating cooking vapors and odor pollutants released during cooking which are retrieved and circulated to the flame burner of the heat exchanger for incineration serving to reduce the pollutants released to the atmosphere, the improvement comprising:

housing means enclosing a tube array in which there is circulated a heat transfer or a cooking fluid to be heated for cooking the food product and a combustion chamber, burner means arranged on said housing to project a flame into said combustion chamber, plenum means proximate said burner means and equipped to receive the cooking vapors from the cooking system and having a discharge opening serving to release such vapors and odor pollutants into the combustion chamber, baffle means mounted in said combustion chamber and extending thereacross in a plane generally normal to the principal axis of the burner flame, said baffle means having a central opening therein serving to pass combustion gases therethrough along the path towards the tube array to an exhaust discharge from said heat exchanger, and a frusto-conically shaped, turbulence increasing body mounted in said combustion chamber intermediate said flame and said baffle means in a spaced apart relation with respect to said baffle means so as to define an annular flow slot to pass combustion gases therethrough from along the sidewalls of said conical body through said opening in said baffle means, said body being arranged to project towards said burner flame and having a central combustion gas flow passageway extending therethrough.

2. The improvement in the heat exchanger of claim 1 wherein means are provided for mounting said frusto-conically shaped body concentrically with respect to said central opening in said baffle and in a manner for fixedly spacing said body at a plurality of selected distances from said baffle means for changing the size of and the flow rates of combustion gases through said annular flow slot.

3. The improvement in the heat exchanger of claim 1 wherein said turbulence increasing body is positioned a distance with respect to said baffle means with the major base of said body closest to and generally parallel with said baffle means, and the diameter of said major base being selected so that the vena contracta created by gas flow with respect to said body is larger in diameter than the diameter of the central opening in said baffle means.

4. The combination stated in claim 3 wherein said turbulence increasing body has a minor base having said opening for combustion gas flow therethrough serving to improve mixing of the pollutants and combustion gases in said combustion chamber.

5. The combination stated in claim 3 wherein said diameter of the major base of said body is selected so that said vena contracta is larger in diameter than the vena contracta created by gas flow through said central opening of said baffle means.

* * * * *